US010578121B2

(12) United States Patent
Tang et al.

(10) Patent No.: US 10,578,121 B2
(45) Date of Patent: Mar. 3, 2020

(54) CEILING FAN BLADE STRUCTURE AND CEILING FAN

(71) Applicants: GD MIDEA ENVIRONMENT APPLIANCES MFG CO., LTD., Zhongshan (CN); MIDEA GROUP CO., LTD., Foshan (CN)

(72) Inventors: Xinmin Tang, Zhongshan (CN); Shuisheng Lei, Zhongshan (CN); Yaoguang Liang, Zhongshan (CN)

( * ) Notice: Subject to any disclaimer, the term of this patent is extended or adjusted under 35 U.S.C. 154(b) by 0 days.

(21) Appl. No.: 15/552,807

(22) PCT Filed: Apr. 19, 2016

(86) PCT No.: PCT/CN2016/079688
§ 371 (c)(1),
(2) Date: Aug. 23, 2017

(87) PCT Pub. No.: WO2017/181349
PCT Pub. Date: Oct. 26, 2017

(65) Prior Publication Data

US 2019/0032673 A1 Jan. 31, 2019

(51) Int. Cl.
*F04D 29/34* (2006.01)
*F04D 25/08* (2006.01)

(52) U.S. Cl.
CPC ..... *F04D 29/34* (2013.01); *F04D 25/088* (2013.01); *F05D 2260/36* (2013.01)

(58) Field of Classification Search
CPC ..... F04D 29/34; F04D 25/088; F05D 2260/36
(Continued)

(56) References Cited

U.S. PATENT DOCUMENTS 5,944,486 A * 8/1999 Hodgkins, Jr. ..... F04D 25/088 403/13
5,980,353 A * 11/1999 Wu ..... F04D 25/088 403/294

(Continued)

FOREIGN PATENT DOCUMENTS

AU 2016387082 B2 11/2017
CN 2586092 Y 11/2003

(Continued)

OTHER PUBLICATIONS

CA Examination Search Report dated Mar. 21, 2019 in the corresponding CA application (application No. 2,974,673).

(Continued)

*Primary Examiner* — J. Todd Newton
(74) *Attorney, Agent, or Firm* — Kilpatrick Townsend & Stockton, LLP

(57) ABSTRACT

A ceiling fan blade structure and a ceiling fan. The ceiling fan blade structure includes: at least one fan blade provided with a first inserting portion; and a mounting plate provided with a second inserting portion, and being able to be detachably connected with the fan blade through a fit between the first inserting portion and the second inserting portion. The installation of the fan blade is changed, and the connecting members used in the existing mounting method of fan blades are removed. The fan blade is provided with the first inserting portion, the mounting plate is provided with the second inserting portion, and through corresponding insertion between the first inserting portion and the second inserting portion, the fan blade may be mounted to the mounting plate rapidly. Moreover, in a mounting process of the fan blade, a mounting operation can be completed without assistance of auxiliary tools.

10 Claims, 9 Drawing Sheets

(58) Field of Classification Search
USPC ..... 416/234
See application file for complete search history.

(56) References Cited

U.S. PATENT DOCUMENTS

| | | | | |
|---|---|---|---|---|
| 6,932,576 | B2 * | 8/2005 | Bird | F04D 25/088 416/206 |
| 8,356,979 | B2 * | 1/2013 | Haynes | F04D 29/34 416/210 R |
| 8,845,293 | B1 * | 9/2014 | Lowe | F04D 29/34 416/205 |
| 10,502,228 | B2 * | 12/2019 | Zauhar | F04D 25/088 |
| 2004/0197193 | A1 | 10/2004 | Bird | |
| 2008/0273979 | A1 * | 11/2008 | Bucher | F04D 25/088 416/210 R |
| 2011/0158813 | A1 * | 6/2011 | Bucher | F04D 25/088 416/210 R |
| 2015/0300364 | A1 * | 10/2015 | Lin | F04D 25/088 416/221 |
| 2019/0032673 | A1 | 1/2019 | Tang et al. | |

FOREIGN PATENT DOCUMENTS

| | | | |
|---|---|---|---|
| CN | 2588092 | Y | 11/2003 |
| CN | 201144867 | Y | 11/2008 |
| CN | 202560635 | U | 11/2012 |
| CN | 202673779 | U | 1/2013 |
| CN | 202926669 | U | 5/2013 |
| CN | 204003607 | U | 12/2014 |
| CN | 105782114 | A | 7/2016 |
| CN | 205533415 | U | 8/2016 |
| EP | 3282131 | A4 | 6/2018 |
| JP | S6014297 | U | 1/1985 |
| TW | M334886 | U | 6/2008 |
| WO | 2017181349 | A1 | 10/2017 |

OTHER PUBLICATIONS

NZ First Examination Report dated Apr. 1, 2019 in the corresponding NZ application (IP No. 734032).
European Office Action dated May 9, 2018 in the corresponding European application (application No. 16888599.4).

* cited by examiner

CEILING FAN BLADE STRUCTURE AND CEILING FAN

CROSS-REFERENCE TO RELATED APPLICATION

This application is a national phase entry under 35 USC § 371 of International Application PCT/CN2016/079688, filed Apr. 19, 2016, the entire content of which is incorporated herein by reference.

FIELD

The present disclosure relates to a field of fan, and more particularly to a ceiling fan blade structure and a ceiling fan having the same.

BACKGROUND

An installation structure of ceiling fan blades currently on the market is complex. As shown in FIGS. 1 and 2, when a fan blade 1' needs to be mounted, the fan bladel' is first mounted to a connecting member 2', each fan blade 1' usually needs to be fixed by means of three or more screws, and moreover, gaskets need to be mounted between the screws and the fan blade 1', which requires a lot of parts and causes high cost. After the fan blade 1' is mounted to the connecting member 2', the connecting member 2' is mounted to a mounting plate (not shown in drawings). The assembly operation of this kind of mounting structure is complicated, takes a very long time, and has to be completed with auxiliary tools.

SUMMARY

The present disclosure aims to solve at least one of the technical problems existing in the related art.

Accordingly, an objective of the present disclosure is to provide a ceiling fan blade structure which is easy to assemble and high in safety.

Another objective of the present disclosure is to provide a ceiling fan having the above ceiling fan blade structure.

In order to achieve the above objectives, embodiments of a first aspect of the present disclosure provide a ceiling fan blade structure. The ceiling fan blade structure includes: at least one fan blade provided with a first inserting portion; and a mounting plate provided with a second inserting portion, and being able to be detachably connected with the fan blade through a fit between the first inserting portion and the second inserting portion.

In the present solution, the installation way of the fan blade is changed, and the connecting members used in the existing mounting method of fan blades are removed. The fan blade is provided with the first inserting portion, the mounting plate is provided with the second inserting portion, and through corresponding insertion between the first inserting portion and the second inserting portion, the fan blade may be mounted to the mounting plate rapidly. Thus, the ceiling fan blade structure is low in number of parts and low in cost. Moreover, during mounting of the fan blade, a mounting operation can be completed without assistance of auxiliary tools, and the mounting operation is simple and takes a short time.

In the above technical solution, preferably, one of the first inserting portion and the second inserting portion includes a plurality of elastic snaps, and the other one thereof includes a plurality of snap grooves; the plurality of elastic snaps are able to be inserted into the plurality of snap grooves respectively and snap-fitted with the plurality of snap grooves respectively, so as to enable the fan blade to be detachably connected with the mounting plate.

In this solution, the detachable connection between the fan blade and the mounting plate is realized through the fit between the elastic snap and the snap groove. During the mounting, the elastic snap is inserted into the snap groove to be snap-fitted with the snap groove, so as to fix the fan blade to the mounting plate. Therefore, the fan blade can be mounted without assistance of auxiliary tools, and the mounting operation is simple and takes a short time.

In any one of the above technical solutions, preferably, one of the first inserting portion and the second inserting portion includes two elastic snaps and one position limiting block, the position limiting block being located between the two elastic snaps; the other one of the first inserting portion and the second inserting portion includes two snap grooves and one position limiting groove, the position limiting groove being located between the two snap grooves.

In this solution, the first inserting portion and the second inserting portion are snap-fitted with each other by means of two pairs of snap grooves and elastic snaps; moreover, the position limiting block and the position limiting groove are provided at positions between two snap fits, and the fit between the position limiting block and the position limiting groove enhances a fixing effect.

In any one of the above technical solutions, preferably, the position limiting groove and the two snap grooves are all configured as through grooves.

In this solution, the snap groove is designed as the through groove to facilitate detachment of the fan blade. During the mounting, the position limiting block is inserted into the position limiting groove, at the same time the elastic snap is inserted from one end of the snap groove, and a hook portion of the elastic snap protrudes from the other end of the snap groove and is snap-fitted with an edge of the snap groove, so as to complete the mounting of the fan blade and the mounting plate. During dismounting, the hook portion of the elastic snap is pulled to be separated from the edge of the snap groove, then the fan blade is pulled to separate the elastic snap from the snap groove, and at the same time the position limiting block is separated from the position limiting groove, therefore the detachment of the fan blade is completed.

In any one of the above technical solutions, preferably, the mounting plate is formed with a protrusive plate protruding outwards, and the protrusive plate is bent to form the position limiting groove and the two snap grooves. A manufacturing process of the mounting plate in this configuration is simple, thereby lowering production cost of the mounting plate.

In any one of the above technical solutions, preferably, the position limiting groove and the two snap grooves are open to reverse directions; when the first inserting portion is fitted and connected with the second inserting portion, the position limiting block abuts against a bottom wall and two side walls of the position limiting groove, and the two elastic snaps abut against respective bottom walls of the two snap grooves and respective side walls, adjacent to and/or away from the position limiting groove, of the two snap grooves.

In this solution, the position limiting groove and the snap groove are configured as through grooves, and an opening of the through groove refers to a notch opposite to a bottom wall of the groove. An opening of the position limiting groove and an opening of the snap groove face different directions, one facing upwards and the other facing downwards. During the mounting of the fan blade to the mounting plate, the position limiting block and the elastic snap abut against bottom walls of the position limiting groove and the snap groove respectively, to guarantee no relative movement between the fan blade and the mounting plate in an up and down direction. Moreover, the position limiting block abuts against two side walls of the position limiting groove, and the two elastic snaps abut against inner side walls and/or outer side walls of the two snap grooves respectively, to guarantee no relative movement between the fan blade and the mounting plate in a left and right direction. This design enhances the fixing effect of the mounting between the fan blade and the mounting plate.

In any one of the above technical solutions, preferably, an opening of the position limiting groove faces upwards, and openings of the two snap grooves face downwards; the two elastic snaps are arranged opposite to each other; when the first inserting portion is fitted and connected with the second inserting portion, the two elastic snaps abut against the respective bottom walls and respective two side walls of the two snap grooves.

In this solution, the elastic snaps are arranged opposite to each other, and when the fan blade and the mounting plate are mounted together, the two elastic snaps abut against the respective bottom walls and respective two side walls of the two snap grooves, so as to achieve the best fixing effect of the elastic snaps on the fan blade.

In any one of the above technical solutions, preferably, the mounting plate is provided with a plurality of second inserting portions equally spaced apart along a circumferential direction.

In this technical solution, the mounting plate is provided with the plurality of second inserting portions, and all fan blades of a ceiling fan are mounted to one mounting plate, such that the ceiling fan blade structure has a small number of parts, and production cost of a product is low. Since there is only one mounting plate, a mounting operation of the mounting plate and other parts of the ceiling fan is also simple, thereby improving assembly efficiency of the product.

In any one of the above technical solutions, preferably, the first inserting portion is provided with a first fixing hole; the second inserting portion is provided with a second fixing hole; when the first inserting portion is fitted and connected with the second inserting portion, the first fixing hole is aligned with the second fixing hole; the ceiling fan blade structure further includes a fixing member, and the fixing member is able to enter the first fixing hole and the second fixing hole and fix the first inserting portion to the second inserting portion.

In this solution, the fixing member serves as an insurance structure for mounting the fan blade, which improves reliability of the mounting between the fan blade and the mounting plate. The first inserting portion is provided with the first fixing hole, and the second inserting portion is provided with the second fixing hole. During the mounting of the fan blade, the first inserting portion is first fitted and connected with the second inserting portion, and then the fixing member is mounted to the first fixing hole and the second fixing hole, such that it is possible to avoid separation of the first inserting portion from the second inserting portion by a fit of the fixing member with the first fixing hole and the second fixing hole, thereby improving safety of the product. During dismounting of the fan blade, the fixing member is first detached, and then the first inserting portion is separated from the second inserting portion, thus the detachment of the fan blade is completed.

Preferably, one of the first fixing hole and the second fixing hole is provided in the position limiting block, the other one thereof is disposed in a wall of the position limiting groove, and the position limiting block is disposed between two snaps and located in a middle position of the first inserting portion or the second inserting portion, such that the fixing member fixes the middle portion of the first inserting portion or the second inserting portion, resulting in a good fixing effect and further improving the reliability of the mounting between the fan blade and the mounting plate.

In any one of the above technical solutions, preferably, the first fixing hole and the second fixing hole are configured as non-circular holes; the fixing member is configured as a fixing pin, and the fixing pin includes a first position limiting portion, a connecting portion and a second position limiting portion, the first position limiting portion, the connecting portion and the second position limiting portion being formed integrally, and the first position limiting portion being in a non-circular shape; during the mounting, an angle of the first position limiting portion relative to the first fixing hole or relative to the second fixing hole is controlled within a first preset range, such that the first position limiting portion is enabled to pass through the first fixing hole and the second fixing hole; afterwards, the fixing pin is rotated to make the angle of the first position limiting portion relative to the first fixing hole or relative to the second fixing hole controlled within a second preset range, such that one of the first position limiting portion and the second position limiting portion abuts against an edge of the first fixing hole, and the other one thereof abuts against an edge of the second fixing hole.

In this solution, during mounting of the fixing pin, the first position limiting portion of the fixing pin passes through the first fixing hole and the second fixing hole, and then the fixing pin is rotated to enable one of the first position limiting portion and the second position limiting portion to abut against the edge of the first fixing hole, and enable the other one thereof to abut against the edge of the second fixing hole. In such a way, the fixing pin is effectively prevented from slipping off from the first fixing hole and the second fixing hole, thereby improving the safety of the product. A dismounting operation of the fixing pin is opposite to a mounting operation thereof, which will not be elaborated herein.

Specifically, an elastic fastening device may be mounted at the first fixing hole and/or the second fixing hole. The elastic fastening device is provided with a through hole that is aligned with the first fixing hole and the second fixing hole and has a width smaller than a width of the connecting portion of the fixing pin. During the mounting of the fixing pin, the elastic fastening device is pressed by the fixing pin and thus deformed elastically, such that the through hole is expanded, and the first position limiting portion and the connecting portion of the fixing pin may pass through the through hole. The elastic fastening device fastens the connecting portion of the fixing pin under the action of its resilient force, so as to avoid self-rotation of the fixing pin due to loosening, and prevent the fixing pin from slipping off from the first fixing hole and the second fixing hole, thereby reducing safety risk of the product.

In the above technical solution, preferably, the second position limiting portion is formed with an operating portion, such that a user may pick or place, and rotate the fixing pin by grasping the operating portion, which may facilitate detachment of the fixing pin. Specifically, the operating portion may be configured as a rib structure.

In any one of the above technical solutions, preferably, the fixing member is configured as a screw, in which a rod portion of the screw is able to pass through the first fixing hole and the second fixing hole, and is screwed with a nut, so as to fix the first inserting portion to the second inserting portion; or in which at least one of the first fixing hole and the second fixing hole is configured as a threaded hole, and the rod portion of the screw is able to be screwed with the threaded hole, so as to fix the first inserting portion to the second inserting portion.

Specifically, if the technical solution of realizing fixation by means of a fit of the screw and the nut is employed, after the screw is mounted, one of a head of the screw and the nut abuts against the fan blade, and the other one thereof abuts against the mounting plate. If the technical solution, in which at least one of the first fixing hole and the second fixing hole is configured as the threaded hole and the screw is screwed with the threaded hole, is adopted, after the screw is mounted, the head of the screw abuts against one of the fan blade and the mounting plate. A fixing hole in the other one of fan blade and the mounting plate must be configured as the threaded hole, such that the rod portion of the screw is screwed with the threaded hole.

It should be noted that the ways in which the fixing member is fitted with the fan blade and the mounting plate include but are not limited to the above several solutions.

Embodiments of a second aspect of the present disclosure provide a ceiling fan, and the ceiling fan includes the ceiling fan blade structure provided in any one of embodiments of the first aspect of the present disclosure.

The ceiling fan provided in embodiments of the second aspect of the present disclosure includes the ceiling fan blade structure provided in any one of embodiments of the first aspect of the present disclosure, so the ceiling fan has all the beneficial effects of ceiling fan blade structure provided in any one of embodiments above, which will not be elaborated herein.

Additional aspects and advantages of the present disclosure will become apparent from the following descriptions part, or be learned from the practice of the present disclosure.

BRIEF DESCRIPTION OF THE DRAWINGS

These and/or other aspects and advantages of the present disclosure will become apparent and more readily appreciated from the following descriptions of embodiments made with reference to the drawings, in which.

Figure 1:
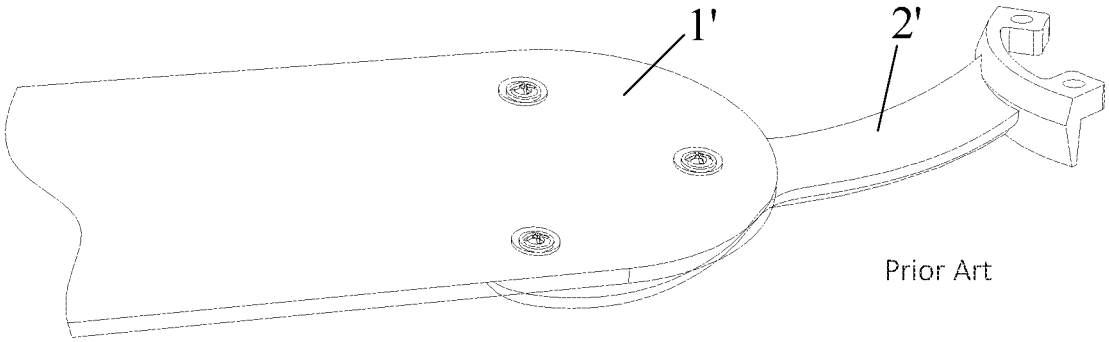
FIG. 1 is a schematic view of a ceiling fan blade structure in the prior art.
Figure 2:
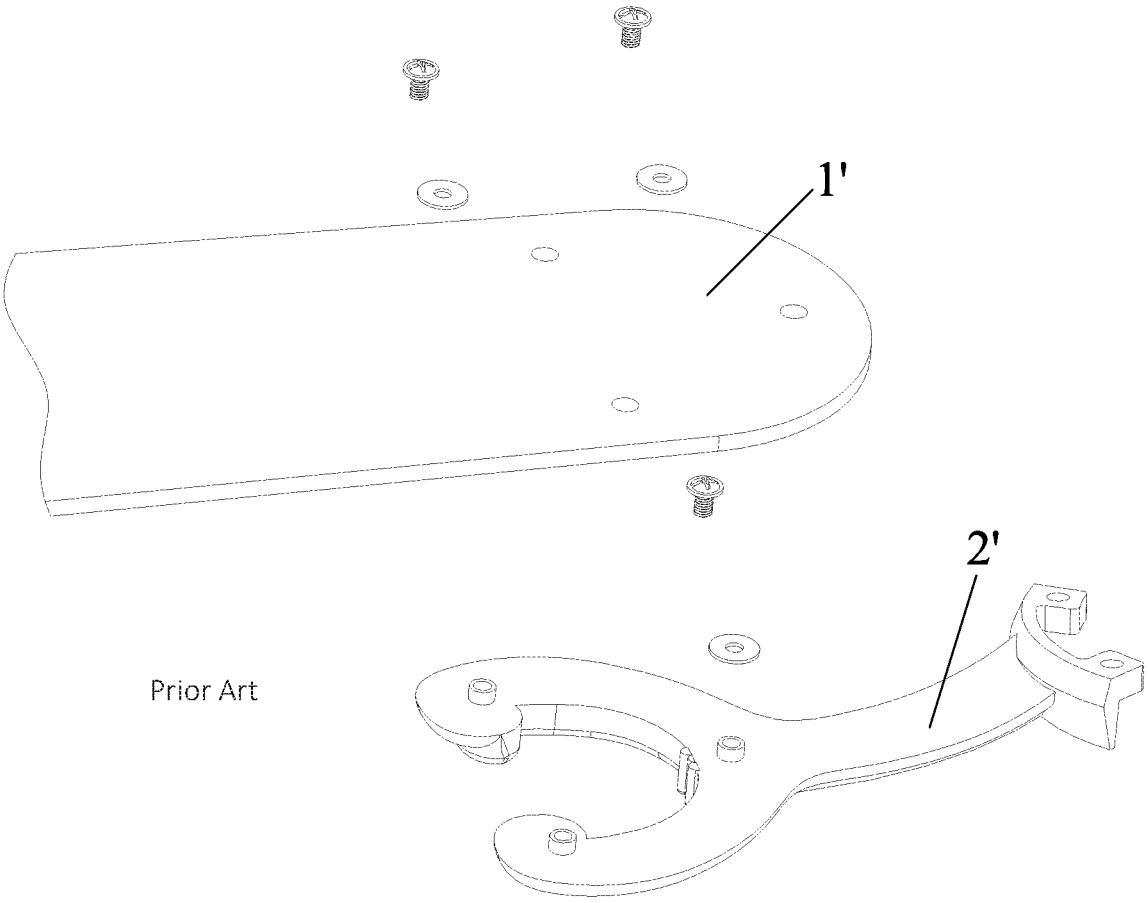
FIG. 2 is an exploded schematic view of the ceiling fan blade structure shown in FIG. 1.
Figure 3:
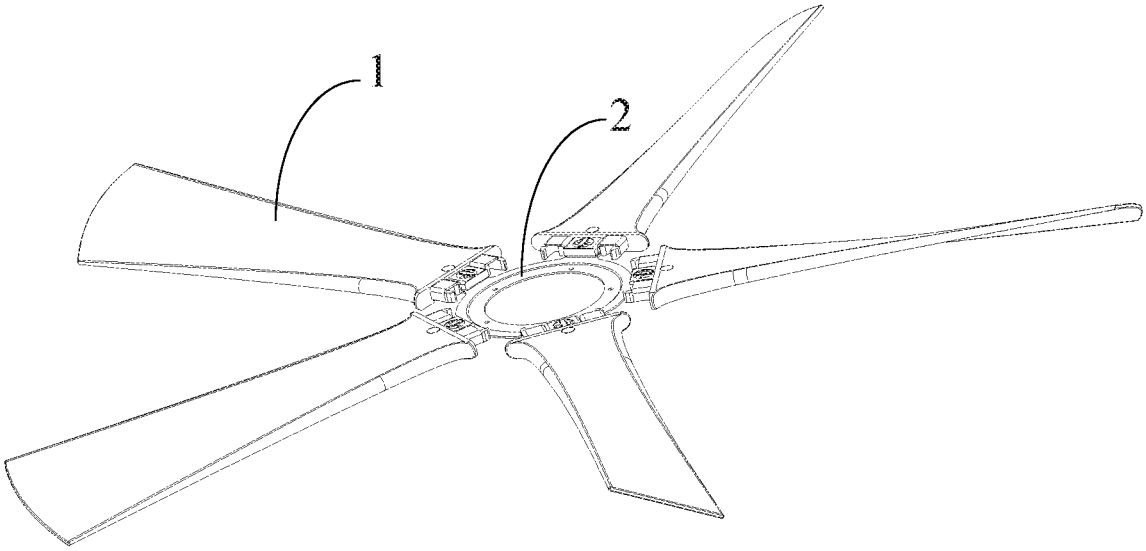
FIG. 3 is a schematic view of a ceiling fan blade structure provided in an embodiment of the present disclosure.
Figure 4:
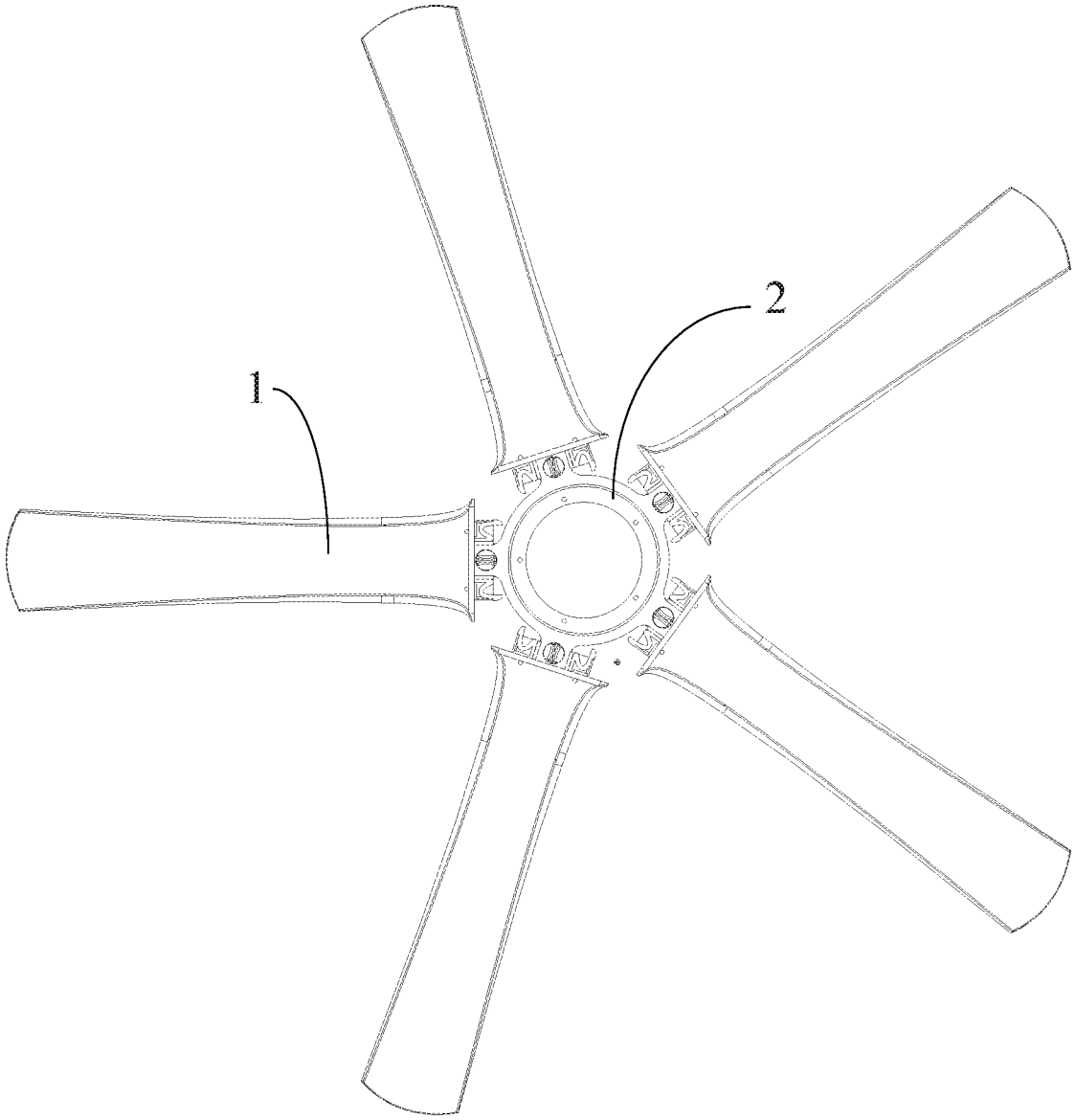
FIG. 4 is a schematic view of the ceiling fan blade structure in FIG. 3 from another angle of view.
Figure 5:
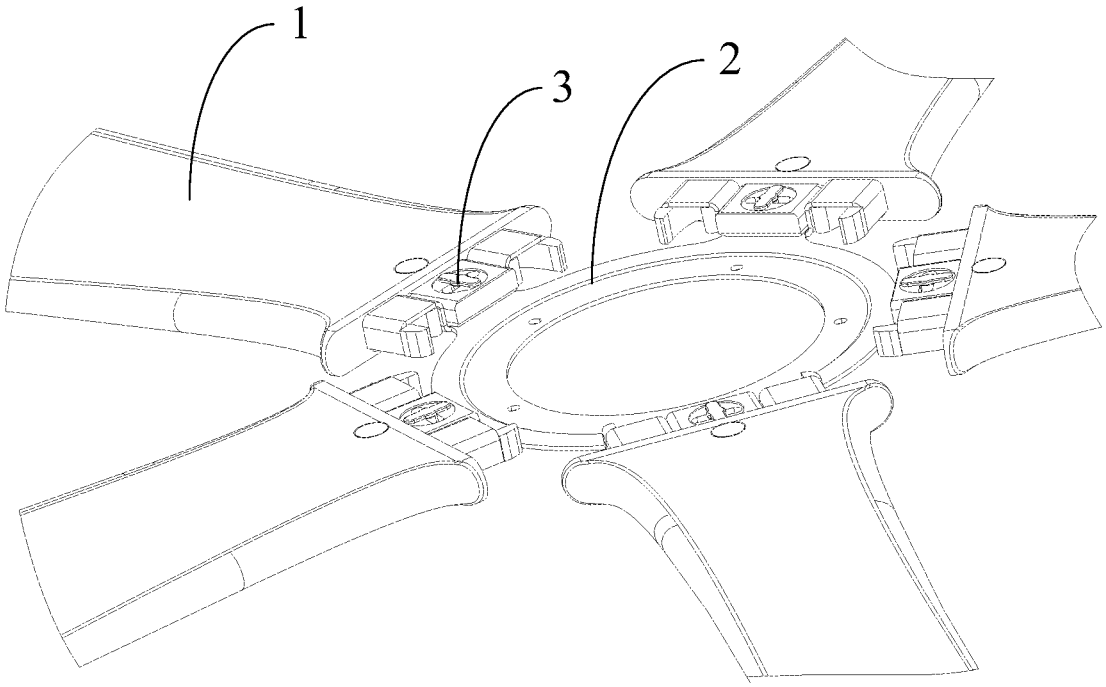
FIG. 5 is a partially enlarged view of the ceiling fan blade structure in FIG. 3.
Figure 6:
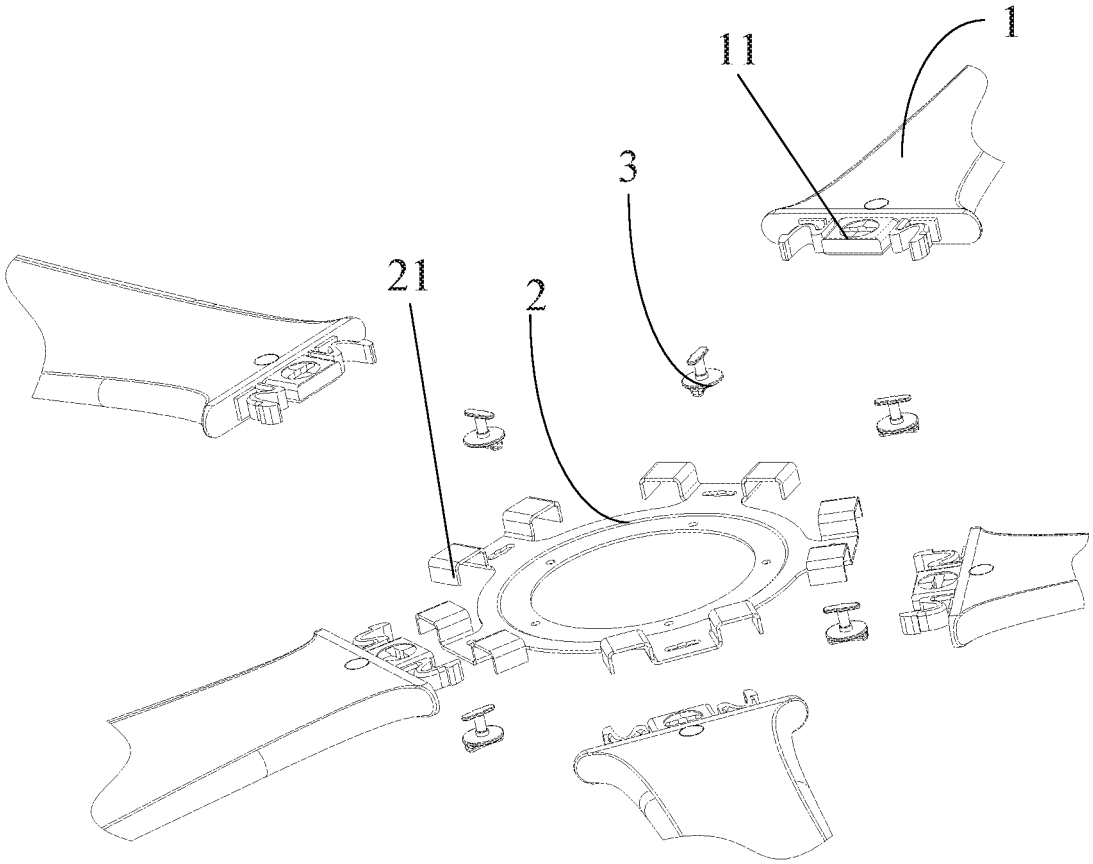
FIG. 6 is an exploded schematic view of the ceiling fan blade structure shown in FIG. 5.
Figure 7:
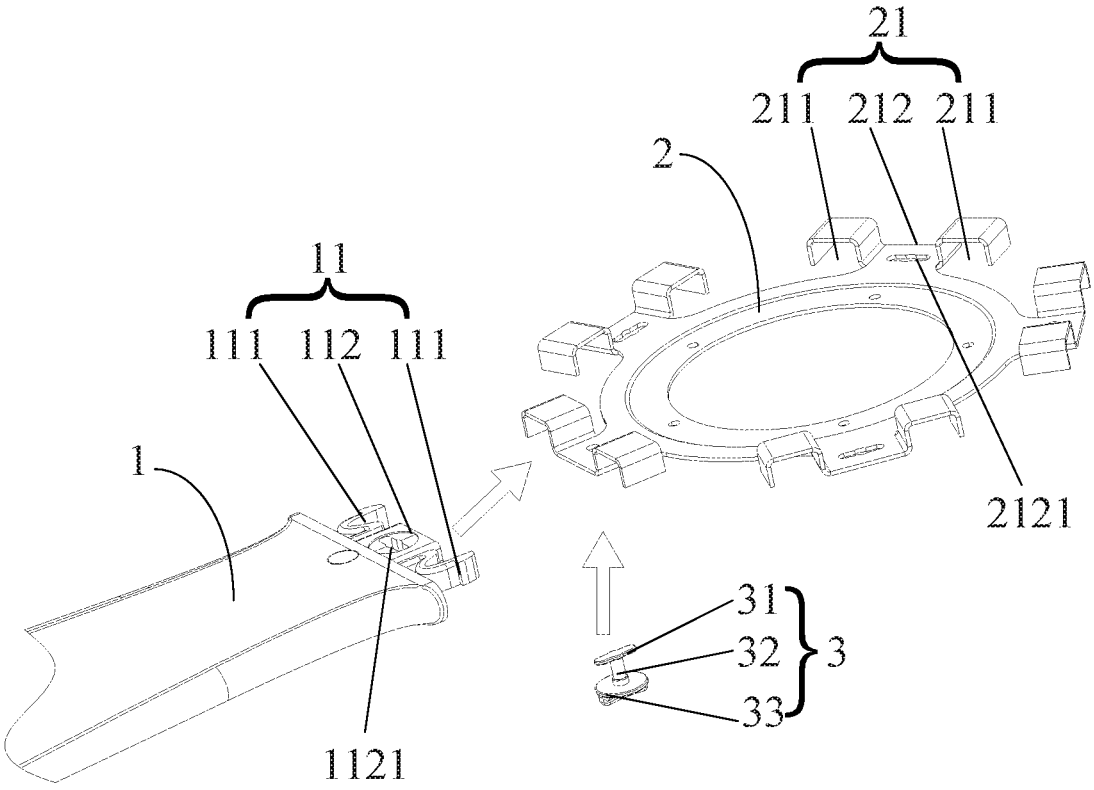
FIG. 7 is an assembly diagram of the ceiling fan blade structure shown in FIG. 5.

An arrow in FIG. 7 indicates a movement direction of a part to be mounted.

The corresponding relations between reference numerals and component names in FIGS. 3 to 7 are:

1 fan blade, 11 first inserting portion, 111 elastic snap, 112 position limiting block, 1121 first fixing hole, 2 mounting plate, 21 second inserting portion, 211 snap groove, 212 position limiting groove, 2121 second fixing hole, 3 fixing pin, 31 first position limiting portion, 32 connecting portion, 33 second position limiting portion, 331 operating portion.

DETAILED DESCRIPTION

The present disclosure will be described in further detail with reference to the accompanying drawings and specific embodiments to provide a clearer understanding of the objectives, features and advantages of the present disclosure above-mentioned. It should be noted that embodiments and features in embodiments of the present disclosure may be combined with each other in the case of no conflict.

Many specific details set forth in the following description are intended to facilitate a thorough understanding of the present disclosure, but the present disclosure may be implemented otherwise than as described herein, and thus the protection scope of the present disclosure is not limited to the following specific embodiments.

As shown in FIGS. 3 to 11, embodiments of a first aspect of the present disclosure provide a ceiling fan blade structure. The structure includes at least one fan blade 1 provided with a first inserting portion 11, and a mounting plate 2 provided with a second inserting portion 21. The mounting plate 2 is able to be detachably connected with the fan blade 1 through a fit between the first inserting portion 11 and the second inserting portion 21.

The installation way of the fan blade 1 is changed, and the connecting members used in the existing mounting method of fan blades are removed. The fan blade 1 is provided with the first inserting portion 11, the mounting plate 2 is provided with the second inserting portion 21, and through corresponding insertion between the first inserting portion 11 and the second inserting portion 21, the fan blade 1 may be mounted to the mounting plate 2 rapidly. Thus, the ceiling fan blade structure is low in number of parts and low in cost. Moreover, during mounting of the fan blade 1, a mounting operation can be completed without assistance of auxiliary tools, and the mounting operation is simple and takes a short time.

In the above technical solution, preferably, one of the first inserting portion 11 and the second inserting portion 21 includes a plurality of elastic snaps 111, and the other one thereof includes a plurality of snap grooves 211. The plurality of elastic snaps 111 can be inserted into the plurality of snap grooves 211 respectively, and snap-fitted with the plurality of snap grooves 211 respectively, so as to enable the fan blade 1 to be detachably connected with the mounting plate 2.

In this solution, the detachable connection between the fan blade 1 and the mounting plate 2 is realized through the fit between the elastic snap 111 and the snap groove 211. During the mounting, the elastic snap 111 is inserted into the snap groove 211 to be snap-fitted with the snap groove 211, so as to fix the fan blade 1 to the mounting plate 2. Therefore, the fan blade 1 can be mounted without assistance of auxiliary tools, and the mounting operation is simple and takes a short time.

As shown in FIGS. 6 to 10, in any one of the above technical solutions, preferably, one of the first inserting portion 11 and the second inserting portion 21 includes two elastic snaps 111 and one position limiting block 112, in which the position limiting block 112 is located between the two elastic snaps 111; the other one thereof includes two snap grooves 211 and one position limiting groove 212, in which the position limiting groove 212 is located between the two snap grooves 211.

In this solution, the first inserting portion 11 and the second inserting portion 21 are snap-fitted with each other by means of two pairs of snap grooves 211 and elastic snaps 111; moreover, the position limiting block 112 and the position limiting groove 212 are provided in positions between two snap fits, and the fit between the position limiting block 112 and the position limiting groove 212 enhances a fixing effect.

In any one of the above technical solutions, preferably, the position limiting groove 212 and the two snap grooves 211 are all configured as through grooves.

In this solution, the snap groove 211 is designed as the through groove to facilitate detachment of the fan blade 1. During the mounting, the position limiting block 112 is inserted into the position limiting groove 212, at the same time the elastic snap 111 is inserted from one end of the snap groove 211, and a hook portion of the elastic snap 111 protrudes from the other end of the snap groove 211 and is snap-fitted with an edge of the snap groove 211, so as to complete the mounting of the fan blade 1 and the mounting plate 2. During dismounting, the hook portion of the elastic snap 111 is pulled to be separated from the edge of the snap groove 211, then the fan blade 1 is pulled to separate the elastic snap 111 from the snap groove 211, and at the same time the position limiting block 112 is separated from the position limiting groove 212, therefore the detachment of the fan blade 1 is completed.

In any one of the above technical solutions, preferably, the mounting plate 2 is formed with a protrusive plate protruding outwards, and the protrusive plate is bent to form the position limiting groove 212 and the two snap grooves 211. A manufacturing process of the mounting plate 2 in this configuration is simple, thereby lowering production cost of the mounting plate 2.

In any one of the above technical solutions, preferably, the position limiting groove 212 and the two snap grooves 211 are open to reverse directions. When the first inserting portion 11 is fitted and connected with the second inserting portion 21, the position limiting block 112 abuts against a bottom wall and two side walls of the position limiting groove 212, and the two elastic snaps 111 abut against respective bottom walls of the two snap grooves 211 and respective side walls, adjacent to and/or away from the position limiting groove 212, of the two snap grooves 211.

In this technical solution, the position limiting groove 212 and the snap groove 211 are configured as through grooves, and an opening of the through groove refers to a notch opposite to a bottom wall of the groove. An opening of the position limiting groove 212 and an opening of the snap groove 211 face different directions, one facing upwards and the other facing downwards. When the fan blade 1 is mounted to the mounting plate 2, the position limiting block 112 and the elastic snap 111 abut against bottom walls of the position limiting groove 212 and the snap groove 211 respectively, to guarantee no relative movement between the fan blade 1 and the mounting plate 2 in an up and down direction. Moreover, the position limiting block 112 abuts against two side walls of the position limiting groove 212, and the two elastic snaps 111 abut against inner side walls and/or outer side walls of the two snap grooves 211 respectively, to guarantee no relative movement between the fan blade 1 and the mounting plate 2 in a left and right direction. This design enhances the fixing effect of the mounting between the fan blade 1 and the mounting plate 2.

As shown in FIGS. 6 to 9, in any one of the above technical solutions, preferably, the opening of the position limiting groove 212 faces upwards, and openings of the two snap grooves 211 face downwards; the two elastic snaps 111 are arranged opposite to each other; when the first inserting portion 11 is fitted and connected with the second inserting portion 21, the two elastic snaps 111 abut against the respective bottom walls and respective two side walls of the two snap grooves 211.

In this solution, the elastic snaps 111 are arranged opposite to each other, and when the fan blade 1 and the mounting plate 2 are mounted together, the two elastic snaps 111 abut against the respective bottom walls and respective two side walls of the two snap grooves 211, so as to achieve the best fixing effect of the elastic snap 111 on the fan blade 1.

As shown in FIGS. 3 to 7, in any one of the above technical solutions, preferably, the mounting plate 2 is provided with a plurality of second inserting portions 21 equally spaced apart along a circumferential direction.

In this technical solution, the mounting plate 2 is provided with the plurality of second inserting portions 21, and all fan blades 1 of a ceiling fan are mounted to one mounting plate 2, such that the ceiling fan blade structure has a small number of parts, and production cost of a product is low. Since there is only one mounting plate 2, a mounting operation of the mounting plate 2 and other parts of the ceiling fan is also simple, thereby improving assembly efficiency of the product.

As shown in FIGS. 4 to 8, in any one of the above technical solutions, preferably, the first inserting portion 11 is provided with a first fixing hole 1121, and the second inserting portion 21 is provided with a second fixing hole 2121; when the first inserting portion 11 is fitted and connected with the second inserting portion 21, the first fixing hole 1121 is aligned with the second fixing hole 2121; the ceiling fan blade structure further includes a fixing member, and the fixing member is able to enter the first fixing hole 1121 and the second fixing hole 2121 and fix the first inserting portion 11 to the second inserting portion 21.

In this solution, the fixing member serves as an insurance structure for mounting the fan blade 1, which improves reliability of the mounting between the fan blade 1 and the mounting plate 2. The first inserting portion 11 is provided with the first fixing hole 1121, and the second inserting portion 21 is provided with the second fixing hole 2121. During the mounting of the fan blade 1, the first inserting portion 11 is first fitted and connected with the second inserting portion 21, and then the fixing member is mounted to the first fixing hole 1121 and the second fixing hole 2121, such that it is possible to avoid separation of the first inserting portion 11 from the second inserting portion 21 by a fit of the fixing member with the first fixing hole 1121 and the second fixing hole 2121, thereby improving safety of the product. During dismounting of the fan blade 1, the fixing member is first detached, and then the first inserting portion 11 is separated from the second inserting portion 21, thus the detachment of the fan blade 1 is completed.

Preferably, one of the first fixing hole 1121 and the second fixing hole 2121 is provided in the position limiting block 112, the other one thereof is disposed in a wall of the position limiting groove 212, and the position limiting block 112 is disposed between two snaps and located in a middle position of the first inserting portion 11 or the second inserting portion 21, such that the fixing member fixes the middle portion of the first inserting portion 11 or the second inserting portion 21, resulting in a good fixing effect and further improving the mounting reliability of the fan blade 1 and the mounting plate 2.

The manner in which the fixing member is fitted with the fan blade 1 and the mounting plate 2 includes various embodiments.

Embodiment 1

As shown in FIGS. 5 to 8, the first fixing hole 1121 and the second fixing hole 2121 are configured as non-circular holes; the fixing member is configured as a fixing pin 3, and the fixing pin 3 includes a first position limiting portion 31, a connecting portion 32 and a second position limiting portion 33, the first position limiting portion 31, the connecting portion 32 and the second position limiting portion 33 being formed integrally and the first position limiting portion 31 is in a non-circular shape. During the mounting, an angle of the first position limiting portion 31 relative to the first fixing hole 1121 or relative to the second fixing hole 2121 is controlled within a first preset range, such that the first position limiting portion 31 is enabled to pass through the first fixing hole 1121 and the second fixing hole 2121; afterwards, the fixing pin 3 is rotated to make the angle of the first position limiting portion 31 relative to the first fixing hole 1121 or relative to the second fixing hole 2121 controlled within a second preset range, such that one of the first position limiting portion 31 and the second position limiting portion 33 abuts against an edge of the first fixing hole 1121, and the other one thereof abuts against an edge of the second fixing hole 2121.

In this solution, during mounting of the fixing pin 3, the first position limiting portion 31 of the fixing pin 3 passes through the first fixing hole 1121 and the second fixing hole 2121, and then the fixing pin 3 is rotated to enable one of the first position limiting portion 31 and the second position limiting portion 33 to abut against the edge of the first fixing hole 1121, and enable the other one thereof to abut against the edge of the second fixing hole 2121. In such a way, the fixing pin 3 is effectively prevented from slipping off from the first fixing hole 1121 and the second fixing hole 2121, thereby improving the safety of the product. A dismounting operation of the fixing pin 3 is opposite to a mounting operation thereof, which will not be elaborated herein.

Specifically, an elastic fastening device may be mounted at the first fixing hole 1121 and/or the second fixing hole 2121. The elastic fastening device is provided with a through hole that is aligned with the first fixing hole 1121 and the second fixing hole 2121 and has a width smaller than a width of the connecting portion 32 of the fixing pin 3. During the mounting of the fixing pin 3, the elastic fastening device is pressed by the fixing pin 3 and thus deformed elastically, such that the through hole is expanded, and the first position limiting portion 31 and the connecting portion 32 of the fixing pin 3 may pass through the through hole. The elastic fastening device fastens the connecting portion 32 of the fixing pin 3 under the action of its resilient force, so as to avoid self-rotation of the fixing pin due to loosening, and prevent the fixing pin 3 from slipping off from the first fixing hole 1121 and the second fixing hole 2121, thereby reducing safety risk of the product.

Figure 8:
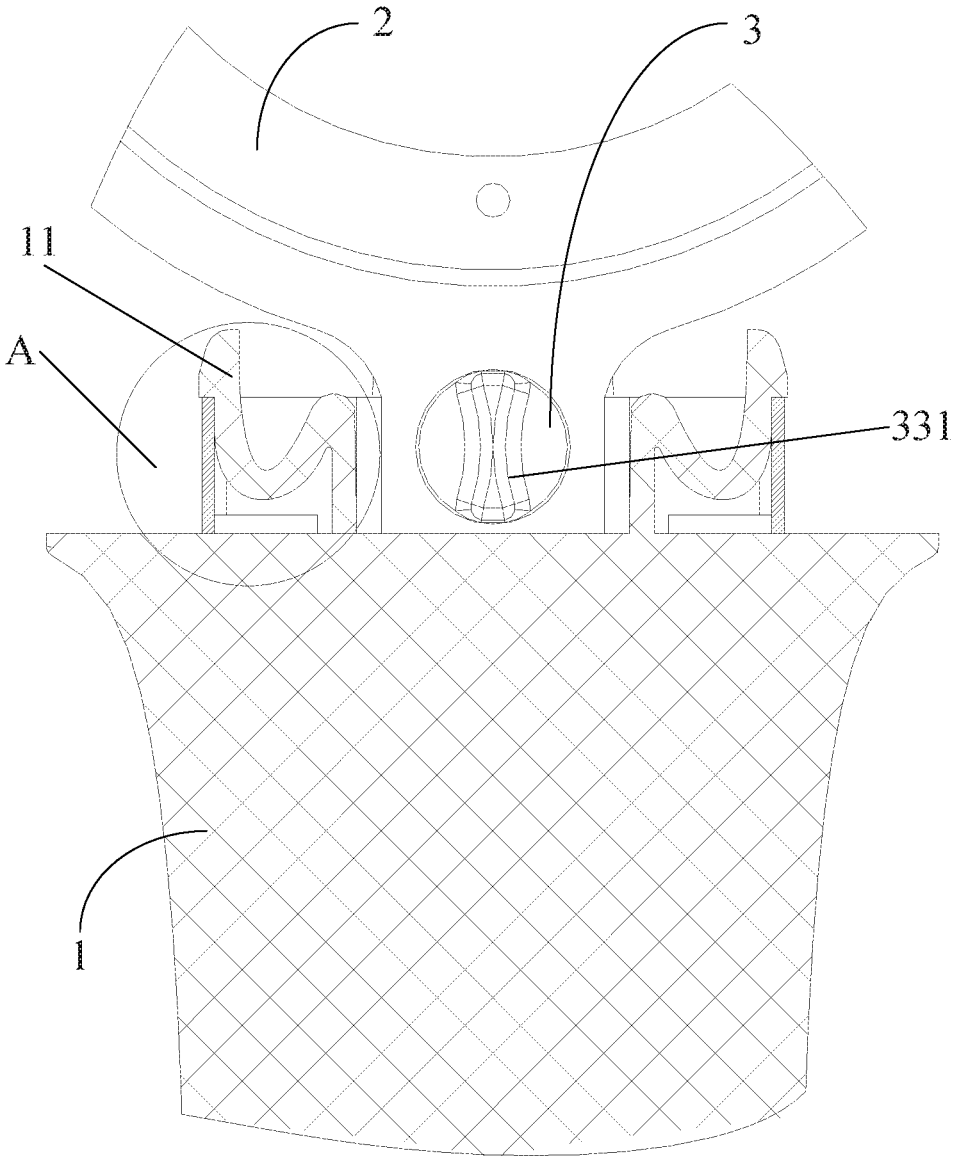
FIG. 8 is an enlarged partially sectional view of the ceiling fan blade structure shown in FIG. 4.
Figure 9:
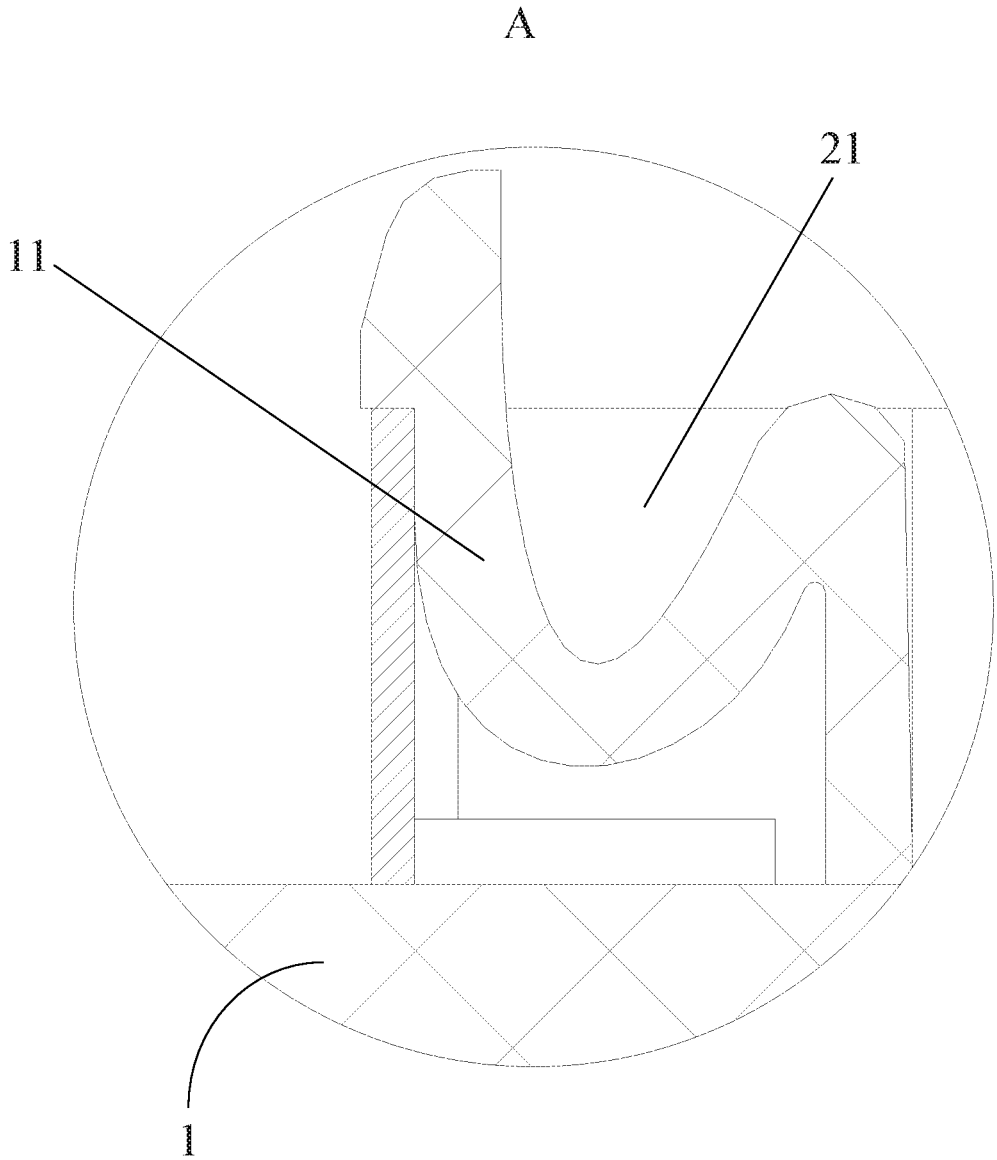
FIG. 9 is an enlarged view of part A in FIG. 8.
Figure 10:
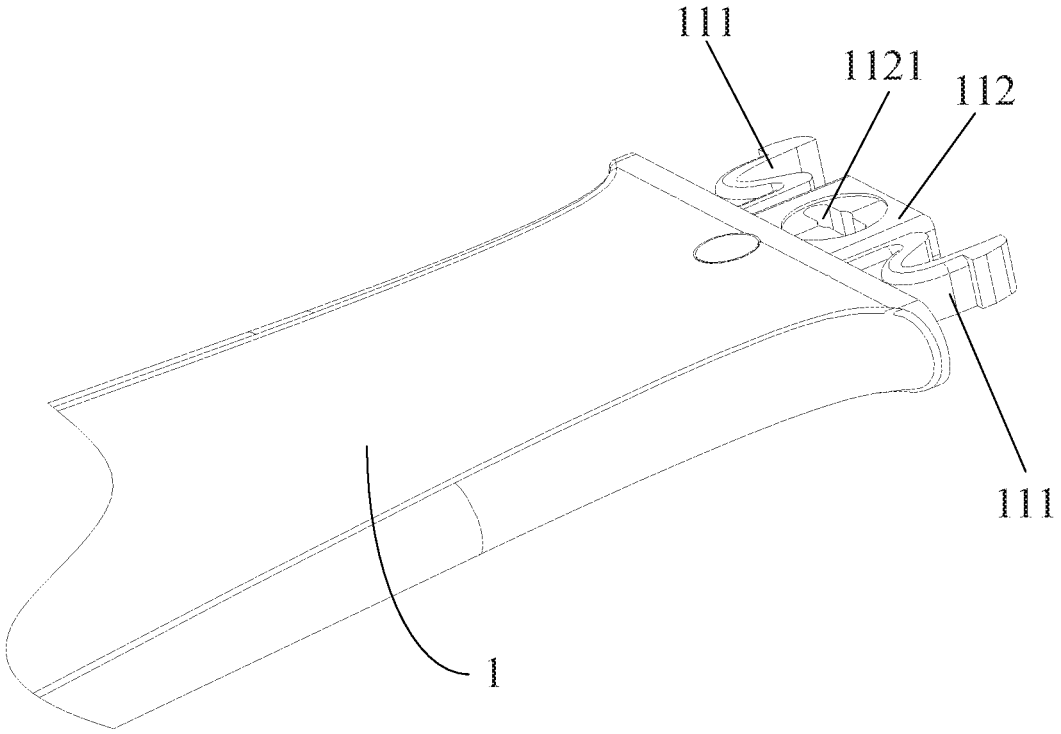
FIG. 10 is a schematic view of a fan blade shown in FIG. 5.
Figure 11:
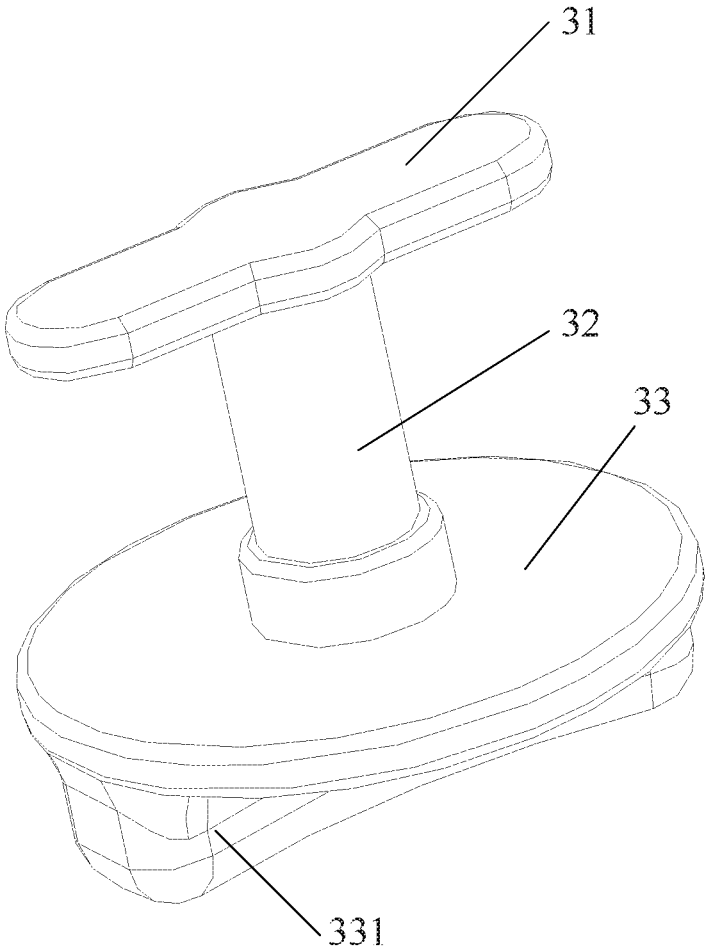
FIG. 11 is a schematic view of a fixing pin shown in FIG. 5.

As shown in FIGS. 8 and 11, in the above technical solution, preferably, the second position limiting portion 33 is formed with an operating portion 331, such that a user may pick or place, and rotate the fixing pin 3 by grasping the operating portion 331, which may facilitate detachment of the fixing pin 3. Specifically, the operating portion 331 may be configured as a rib structure.

Embodiment 2 (Not Shown in Drawings)

The fixing member is configured as a screw. A rod portion of the screw is able to pass through the first fixing hole and the second fixing hole, and is screwed with a nut. After the screw is mounted, one of a head of the screw and the nut abuts against the fan blade, and the other one thereof abuts against the mounting plate, so as to fix the first inserting portion to the second inserting portion.

Embodiment 3 (Not Shown in Drawings)

The fixing member is configured as a screw. At least one of the first fixing hole and the second fixing hole is configured as a threaded hole. A rod portion of the screw is able to be screwed with the threaded hole. After the screw is mounted, a head of the screw abuts against one of the fan blade and the mounting plate. A fixing hole in the other one of fan blade and the mounting plate must be configured as the threaded hole, such that the rod portion of the screw is screwed with the threaded hole, to fix the first inserting portion to the second inserting portion.

It should be noted that the ways in which the fixing member is fitted with the fan blade and the mounting plate include but are not limited to the above several solutions.

Embodiments of a second aspect of the present disclosure provide a ceiling fan (not shown in drawings), and the ceiling fan includes the ceiling fan blade structure provided in any one of embodiments of the first aspect of the present disclosure.

The ceiling fan provided in embodiments of the second aspect of the present disclosure includes the ceiling fan blade structure provided in any one of embodiments of the first aspect of the present disclosure, so the ceiling fan has all the beneficial effects of ceiling fan blade structure provided in any one of the above embodiments, which will not be elaborated herein.

In the descriptions of the present disclosure, it should be understood that terms such as "first" and "second" are used herein only for purposes of description and are not intended to indicate or imply relative importance, unless specified or limited otherwise. Terms "connected," "mounted" and "fixed" are interpreted broadly and may be, for example, fixed connections, detachable connections, or integral connections; may also be direct connections or indirect connections via intervening structures, which can be understood by those skilled in the art according to specific situations.

In the description of the present disclosure, it should be understood that terms "on," "below," "left" or "right" should be construed to refer to the orientation as then described or as shown in the drawings under discussion. These relative terms are for convenience of description and do not indicate or imply that the device or element referred to must have a particular orientation, or be constructed or operated in a particular orientation. Thus, the terms cannot be constructed to limit the present disclosure.

Reference throughout this specification to "an embodiment," "some embodiments" or "a specific embodiment," means that a particular feature, structure, material, or characteristic described in connection with the embodiment or example is included in at least one embodiment or example of the present disclosure. Thus, the appearances of the above phrases throughout this specification are not necessarily referring to the same embodiment or example of the present disclosure.

Although only preferred embodiments of the present disclosure have been illustrated, it shall be understood that the preferred embodiments are not constructed to limit the present disclosure, and various modifications and changes are acceptable for those skilled in the art. Any modifications, equivalents, alternatives, and improvements without departing from spirit and principles of the present disclosure can fall into the protection scope of the present disclosure.

What is claimed is:

1. A ceiling fan blade structure, comprising:

at least one fan blade provided with a first inserting portion; and a mounting plate provided with a second inserting portion, wherein the first inserting portion and the second inserting portion are configured to be detachably connected with each other;

wherein one of the first inserting portion and the second inserting portion comprises two elastic snaps, the two elastic snaps are arranged opposite to each other; the other one of the first inserting portion and the second inserting portion comprises two snap grooves, the two elastic snaps are configured to be inserted into the two snap grooves and snap-fitted with the two snap grooves respectively;

when the first inserting portion is connected with the second inserting portion, the two elastic snaps abut against side walls of the two snap grooves respectively, a hook portion of the elastic snap protrudes from one end of the snap groove and is snap-fitted with an edge of the snap groove.

2. The ceiling fan blade structure according to claim 1, wherein one position limiting block is provided between the two elastic snaps, one position limiting groove is provided between the two snap grooves.

3. The ceiling fan blade structure according to claim 2, wherein the position limiting groove and the two snap grooves are all configured as through grooves.

4. The ceiling fan blade structure according to claim 2, wherein the mounting plate is formed with a protrusive plate protruding outwards, and the protrusive plate is bent to form the position limiting groove and the two snap grooves.

5. The ceiling fan blade structure according to claim 2, wherein openings of the position limiting groove and openings of the two snap grooves are towards opposite directions;

when the first inserting portion is fitted and connected with the second inserting portion, the position limiting block abuts against a bottom wall and two side walls of the position limiting groove, and the two elastic snaps abut against respective bottom walls of the two snap grooves.

6. The ceiling fan blade structure according to claim 1, wherein the mounting plate is provided with a plurality of second inserting portions equally spaced apart along a circumferential direction.

7. The ceiling fan blade structure according to claim 1, wherein the first inserting portion is provided with a first fixing hole;

the second inserting portion is provided with a second fixing hole, and when the first inserting portion is fitted and connected with the second inserting portion, the first fixing hole is aligned with the second fixing hole;

the ceiling fan blade structure further comprises a fixing member, and the fixing member is able to enter the first fixing hole and the second fixing hole and fix the first inserting portion to the second inserting portion.

8. The ceiling fan blade structure according to claim 7, wherein the first fixing hole and the second fixing hole are configured as non-circular holes;

the fixing member is configured as a fixing pin, and the fixing pin comprises a first position limiting portion, a connecting portion and a second position limiting portion, the first position limiting portion, the connecting portion and the second position limiting portion being formed integrally, and the first position limiting portion being in a non-circular shape.

9. The ceiling fan blade structure according to claim 7, wherein the fixing member is configured as a screw, wherein a rod portion of the screw is able to pass through the first fixing hole and the second fixing hole, and is screwed with a nut, so as to fix the first inserting portion to the second inserting portion; or wherein at least one of the first fixing hole and the second fixing hole is configured as a threaded hole, and a rod portion of the screw is able to be screwed with the threaded hole, so as to fix the first inserting portion to the second inserting portion.

10. A ceiling fan, comprising a ceiling fan blade structure according to claim 1.

* * * * *